US005432002A

United States Patent [19]

Krämer

[11] Patent Number: 5,432,002

[45] Date of Patent: Jul. 11, 1995

[54] SHAPED-SECTION FINE-FIBRE FILAMENT YARN AND METHOD OF PRODUCING IT

[75] Inventor: Hans-Georg Krämer, Emmenbrücke, Switzerland

[73] Assignee: Rhone-Poulenc Viscosuisse S.A., Emmenbrücke, Switzerland

[21] Appl. No.: 204,148

[22] Filed: Feb. 28, 1994

[30] Foreign Application Priority Data

Jul. 3, 1992 [CH] Switzerland ..... 2109/92

[51] Int. Cl.[6] ..... D02G 3/00

[52] U.S. Cl. ..... 428/397; 428/364; 428/395; 264/211.12

[58] Field of Search ..... 428/364, 397, 395; 264/211.12

[56] References Cited

U.S. PATENT DOCUMENTS

| | | | |
|---|---|---|---|
| 4,801,530 | 1/1989 | Jennings | 428/339 |
| 5,208,106 | 5/1993 | Tung | 428/397 |
| 5,223,197 | 6/1993 | Boles et al. | 264/211.12 |

*Primary Examiner*—Patrick J. Ryan
*Assistant Examiner*—N. Edwards
*Attorney, Agent, or Firm*—Michael J. Striker

[57] ABSTRACT

A profiled filament yarn of polyamide, comprising a partially oriented yarn with a yarn viscosity RV of 40 to 55 and a tenacity of 30 to 45 cN/tex as a feed yarn for texturing, the yarn having a fiber titer of less than 1.5 dtex with reference to a nominal titer, a color uniformity with a coefficient of variation of less than 2%, and a width/length ratio B/L of a fiber cross-section of 0.5 to 0.7.

3 Claims, 1 Drawing Sheet

SHAPED-SECTION FINE-FIBRE FILAMENT YARN AND METHOD OF PRODUCING IT

BACKGROUND OF THE INVENTION

The invention is directed to a lobed or profiled, finefiber filament yarn with a yarn viscosity RV of 40 to 55 and a tenacity of 30 to 45 cN/tex, particularly as a feed yarn for texturing, and to a process for the production of same.

Profiled poly(hexamethylene adipamide) yarns are known (U.S. Pat. No. 4,801,503). The known yarn has a smooth filament with a ribbon-shaped fiber cross section and a filament titer of 2.8 dtex which is suitable as a spandex substitute for the production of hosiery because of its high flexural strength. The low modulus of flexure is due chiefly to the special profiling. The known yarn is produced in two steps as a socalled polyamide LOY yarn.

By polyamide LOY is meant a filament which is wound up at spinning take-off rates of up to approximately 1800 m/min. Polyamide POY is produced by spinning take-off rates between 3700 and 5000 m/min.

A particular disadvantage of polyamide LOY for the proposed use of the present yarn consists in the low spinning rates so that economical production cannot be ensured. A further disadvantage is the pc, or subsequent processing (yarn breakage) of polyamide Loy at high speeds.

As is also known, there has been no success so far in producing finer, profiled filaments with sufficient dyeing uniformity in textile fabrics with acceptable titer uniformity (U%). The production of profiled filaments in the titer range of smooth hosiery yarns with a fineness of dtex 22 f 8, i.e. a filament titer of roughly 2.8 dtex, can easily be accomplished.

On the other hand, the production of a fine-fiber profiled feed yarn of poly(hexamethylene adipamide) (Nylon 6/6) POY involves considerable difficulties. This may be due to the fact that a round fiber cross section represents an ideal which is strayed from considerably in profile spinning. In melt or extrusion spinning, the yarn forming process becomes increasingly unstable with increasing fineness of the fiber. This is manifested chiefly in the sharp reduction in titer uniformity and in irregular dyeing results in the finished fabric. These disadvantages are more pronounced in the extrusion spinning of polyamide POY.

The yarn viscosity is measured in a known manner as relative viscosity (RV) in formic acid.

To determine the uniformity of color, a segment of stocking is knitted from a number of random spinning reels of a batch. The stocking segment is dyed in a known manner in a bath with alizarin light-blue 4GL dye manufactured by Sandoz AG, Basel, and, after drying, the different reflectance (luminosity or brightness) of segments originating from different spinning reels is measured by colorimetry. The coefficient of variation is calculated in a known manner from the reflectance.

SUMMARY OF THE INVENTION

The object of the invention is to provide a fine profiled feed yarn for texturing or afterstretching which is suitable, particularly in weaving, for warp yarns and which does not have the disadvantages of the known profiled yarns with respect to dyeing.

A further object of the invention is to provide a filament yarn which does not have a greasy luster in the finished textile fabric and which has an improved, very soft feel.

This object is met in a profiled yarn, according to the invention, by a fiber titer of 1.5 dtex or less, a high uniformity of color (coefficient of variation) of less than 2%, and a width/length ratio B/L of the fiber cross section of 0.5 to 0.7.

Surprisingly, a profiled yarn with a fiber titer of less than 1.5 dtex shows no visible irregularities such as streaks in the colored fabric. For the first time, a fiber titer with this degree of fineness has been successfully produced with a POY starting material having a color uniformity with a coefficient of variation of less than 2 and a titer uniformity of less than 1 Uster %. The width/length ratio of the filament cross section of 0.5 to 0.7, particularly 0.6, is particularly suitable for textile requirements with respect to luster and feel. The ratio of width to length B/L is used for quantitative detection of the profile character in trilobed yarns as measured from the beginning of the leg or lobe.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

In accordance with the present invention a profiled fine-fibre filament yarn of polyamide which is a partially oriented yarn; with a yarn viscosity RV of 40 to 55 and a tenacity of 30 to 45 cN/tex is provided, in particular as a feed yarn for texturing. The filament yarn is characterized by a fiber titer of less than 1.4 dtex with reference to the nominal titer, a color uniformity with a coefficient of variation of less than 2%, and a width-/length ratio B/L of the fiber cross-section of 0.5 to 0.7.

It is particularly advisable to provide the filament yarn with a trilobed profile. However, yarns with a generally flat profile may also be used for texturing and hosiery.

Extrusion speeds of 8 to 14 m/min, in particular, 8.5 to 10 m/min, preferably 12 m/min, are used in the production of the profiled polyamide filament yarn with a strength of 30 to 45 cN/tex. These speeds contribute substantially to improving the sharpness of outline of the yarn.

The invention will be explained in more detail with reference to examples.

EXAMPLE 1

Granulated poly(hexamethylene adipamide) with a relative viscosity of 41.5 is melted in an extruder in a known manner and spun via a spinning nozzle plate with 52 capillary openings per yarn and a cross-sectional area of 0.1 $mm^2$ per capillary with a capillary length of 1.2 mm and a trilobed capillary cross section at a temperature of the spinning nozzle plate of 276° . The nozzle plate throughput is set for a POY titer of 100 dtex corresponding to a nominal titer of 78 dtex, resulting in a fiber titer of 1.5 dtex. The cooled fiber bundle is converged, provided at the same time with a spin finish in a known manner, intermingled and wound directly on a reel at a spinning rate of 4200 m/min. The produced yarn has a tenacity of 33 cN/tex with an elongation at break of 73%. Its relative viscosity is 44. The titer uniformity is 0.8 U%. The coefficient of variation of dye absorption is 1.02.

Example 2

Example 2 is distinguished from Example 1 in that a spinning nozzle plate with 68 capillary openings per yarn is used. At a nominal titer of 78 dtex, a fiber titer of 1.14 dtex results. The resulting tenacity is 32 cN/tex with an elongation at break of 72%. RV and titer uniformity remain the same.

EXAMPLE 3

Figure 3:
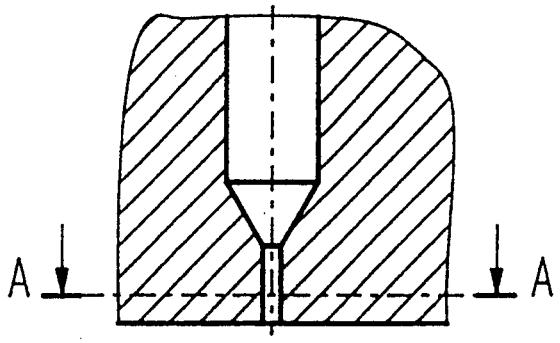
FIG. 3 shows a nozzle with a capillary surface area for extruding the yarn in accordance with the present invention.

FIG. 3 is a view showing a nozzle with a capillary surface area (cross-section) for extruding a polyamide melt to produce the yarn in accordance with the invention.

Example 3 is distinguished from Example 1 by the use of a spinning nozzle plate with 34 capillary openings per yarn. A POY titer of 56 dtex is adjusted. This corresponds to a nominal titer of 44 dtex. The fiber titer is 1.29 dtex. The resulting tenacity is 32.7 cN/tex with an elongation at break of 69%. The spun yarn has a relative viscosity of 40.9. The coefficient of variation of dye absorption is 0.9. A titer uniformity of 0.8 U% is achieved.

Figure 1:
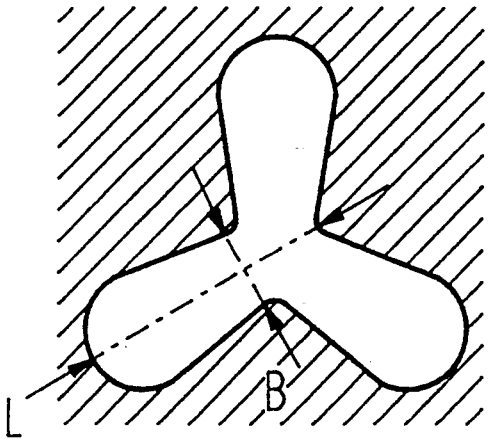
FIG. 1 of the drawings is a view showing a capillary shape of a shaped section fine-fibre filament yarn in accordance with the present invention.

FIG. 1 shows the cross section of a capillary, where B is the width of a leg or lobe and L is the length of the lobe of the capillary.

Figure 2:
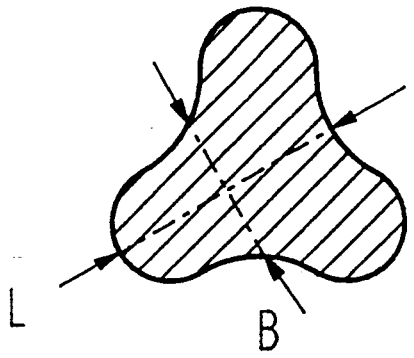
FIG. 2 shows a shape of the filament in accordance with the present invention.

FIG. 2 shows the fiber cross section, where B is the width of a lobe and L is the length of the lobe of the fiber.

The filament yarn, according to the invention, dtex 100 (78) f 52, has good textile characteristics in the fabric and also serves as a feed yarn for texturing according to the false twist and taslan methods, but can also be used for stretching to form a smooth yarn. With its excellent dyeing properties, it is especially suited for use in weaving as a warp yarn.

It will be understood that each of the elements described above, or two or more together, may also find a useful application in other types of constructions differing from the types described above.

While the invention has been illustrated and described as embodied in a shaped-section fine-fibre filament yarn and method of producing it, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. Partially oriented polyamide profiled yarn comprising a yarn having a relative viscosity (RV) of 40 to 55 and a tenacity of 30 to 45 cN/tex as a feed yarn having a fiber titer of less than 1.5 dtex with reference to a nominal titer, and a width/length ratio (B/L) of a fiber cross-section of 0.5 to 0.7.

2. A yarn as defined in claim 1, wherein the yarn has trilobed profile.

3. A method of producing a profiled partially oriented yarn having a tenacity of 30 to 45 cN/tex, the method comprising the steps of extruding a polyamide melt at a rate of 8 to 14 m/min through a nozzle with a capillary surface area of 0.05 $mm^2$ to 0.1 $mm^2$; and winding-on solidified filaments at a rate between 3,700 and 5,000 m/min to form a partially oriented yarn.

* * * * *